US005620089A

United States Patent [19]

Mills

[11] Patent Number: 5,620,089

[45] Date of Patent: Apr. 15, 1997

[54] MAGNETIC KEY HOLDING PLAQUE

[76] Inventor: Glenn A. Mills, 3479 N. Maple Grove, Boise, Id. 83704

[21] Appl. No.: 556,169

[22] Filed: Nov. 9, 1995

[51] Int. Cl.[6] ..... A45C 11/32

[52] U.S. Cl. ..... 206/37.8; 206/37.1; 206/350; 40/330; 70/456 R; 70/460

[58] Field of Search ..... 206/350, 38.1, 206/37.1, 37.4, 37.5, 37.6, 37.7, 37.8, 818; 70/456 R–460, 456 B; 40/330; 335/285, 286

[56] References Cited

U.S. PATENT DOCUMENTS 3,918,503 11/1975 Bundy ..... 206/38.1
4,741,434 5/1988 Liebman ..... 70/456 R
4,881,636 11/1989 Oletzke ..... 206/37.1
4,940,250 7/1990 Corrado ..... 206/37.1

*Primary Examiner*—Jimmy G. Foster
*Assistant Examiner*—Nhan T. Lam

[57] ABSTRACT

A magnetic key holding plaque comprised of a plaque having an inner surface and an outer surface. A plurality of magnets are secured within the inner surface of the plaque. A plurality of magnetic pendants are secured within the outer surface of the plaque opposed from the plurality of magnets.

4 Claims, 3 Drawing Sheets

FIG 1
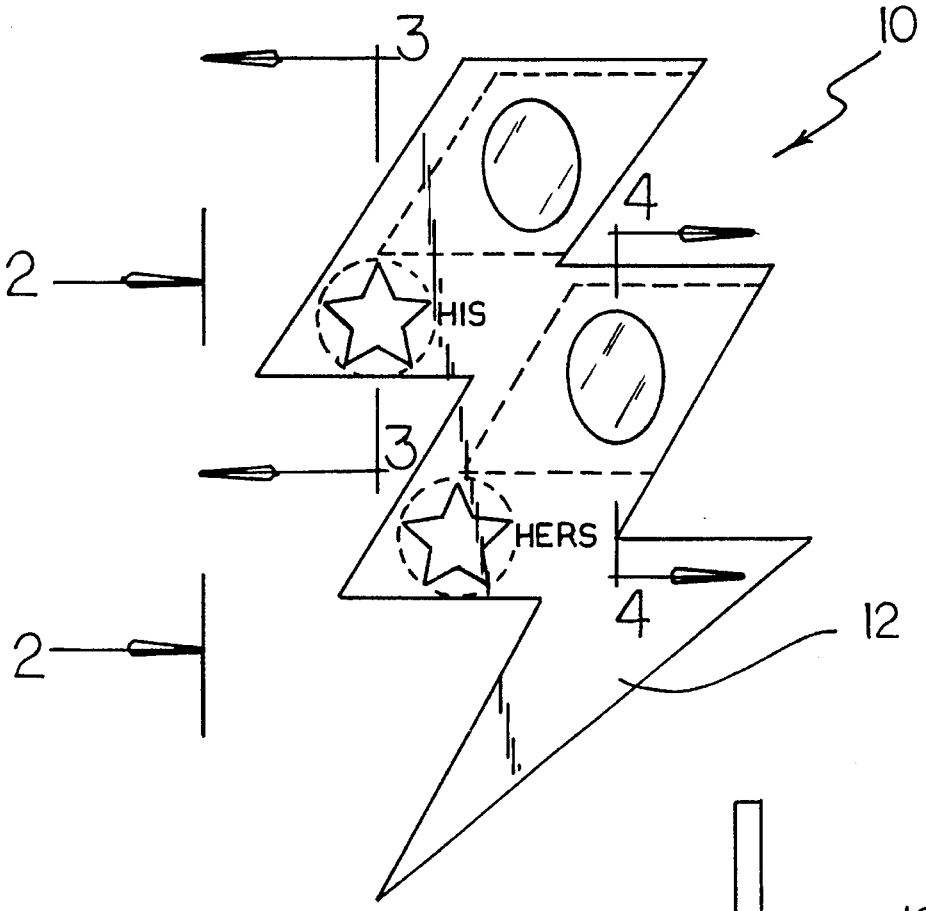
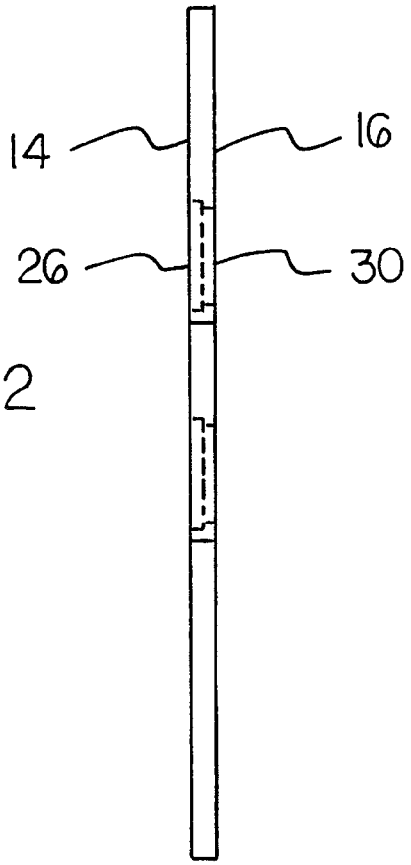
FIG 2

MAGNETIC KEY HOLDING PLAQUE

BACKGROUND OF THE INVENTION

1. Field of the Invention

The present invention relates to a magnetic key holding plaque and more particularly pertains to holding keys with aid of magnets with a magnetic key holding plaque.

2. Description of the Prior Art

The use of key holders is known in the prior art. More specifically, key holders heretofore devised and utilized for the purpose of holding keys are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,457,425 to Cooper et al. discloses a magnetic holder for keys and the like and method of manufacturing the same.

U.S. Pat. No. 4,940,250 to Corrado discloses a magnetic key holder.

U.S. Pat. No. 3,741,376 to Brown, deceased et al. discloses a pocket holder with magnetic clasp.

U.S. Pat. No. 4,004,325 to Hubachek discloses a key ring and/or chain holder.

U.S. Pat. No. Design 308,757 to Sanford discloses the ornamental design for a combined picture mirror and key holder.

U.S. Pat. No. Design 259,453 to Warhaftig discloses the ornamental design for a wall mounted rack for keys.

While these devices fulfill their respective, particular objective and requirements, the aforementioned patents do not describe a magnetic key holding plaque for holding keys with aid of magnets.

In this respect, the magnetic key holding plaque according to the present invention substantially departs from the conventional concepts and designs of the prior art, and in doing so provides an apparatus primarily developed for the purpose of holding keys with aid of magnets.

Therefore, it can be appreciated that there exists a continuing need for new and improved magnetic key holding plaque which can be used for holding keys with aid of magnets. In this regard, the present invention substantially fulfills this need.

SUMMARY OF THE INVENTION

In the view of the foregoing disadvantages inherent in the known types of key holders now present in the prior art, the present invention provides an improved magnetic key holding plaque. As such, the general purpose of the present invention, which will be described subsequently in greater detail, is to provide a new and improved magnetic key holding plaque and method which has all the advantages of the prior art and none of the disadvantages.

To attain this, the present invention essentially comprises a plaque having an inner surface and an outer surface. The outer surface has a plurality of recesses formed therein. A plurality of clear windows are removably coupled within the plurality of recesses of the plaque. A plurality of magnets are secured within the inner surface of the plaque. A plurality of magnetic pendants are secured within the outer surface of the plaque opposed from the plurality of magnets. The plurality of magnetic pendants each have indicia thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter off, the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursor inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic key holding plaque which has all the advantages of the prior art key holders and none of the disadvantages.

It is another object of the present invention to provide a new and improved magnetic key holding plaque which may be easily and efficiently manufactured and marketed.

It is a further object of the present invention to provide a new and improved magnetic key holding plaque which is of durable and reliable construction.

An even further object of the present invention is to provide a new and improved magnetic key holding plaque which is susceptible of a low cost of manufacture with regard to both materials and labor, and which accordingly is then susceptible of low prices of sale to the consuming public, thereby making such a magnetic key holding plaque economically available to the buying public.

Still yet another object of the present invention is to provide a new and improved magnetic key holding plaque which provides in the apparatuses and methods of the prior art some of the advantages thereof, while simultaneously overcoming some of the disadvantages normally associated therewith.

Even still another object of the present invention is to provide a new and improved magnetic key holding plaque for holding keys with aid of magnets.

Lastly, it is an object of the present invention to provide a new and improved magnetic key holding plaque comprised of a plaque having an inner surface and an outer surface. A plurality of magnets are secured within the inner surface of the plaque. A plurality of magnetic pendants are secured within the outer surface of the plaque opposed from the plurality of magnets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of the preferred embodiment of the magnetic key holding plaque constructed in accordance with the principles of the present invention.

FIG. 2 is a cross-sectional view as taken along line 2—2 of FIG. 1.

The same reference numerals refer to the same parts through the various Figures.

DESCRIPTION OF THE PREFERRED EMBODIMENT

Figure 3:
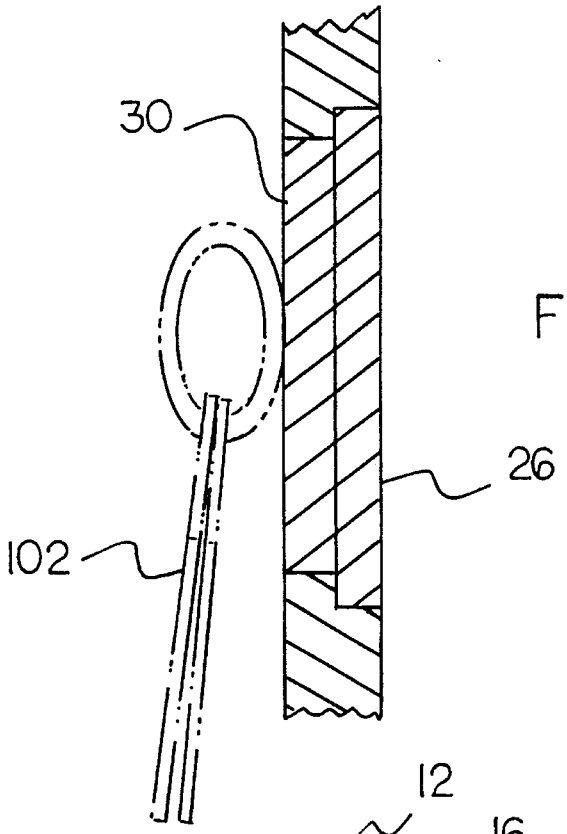
FIG. 3 is a cross-sectional view as taken along line 3—3 of FIG. 1.
Figure 4:
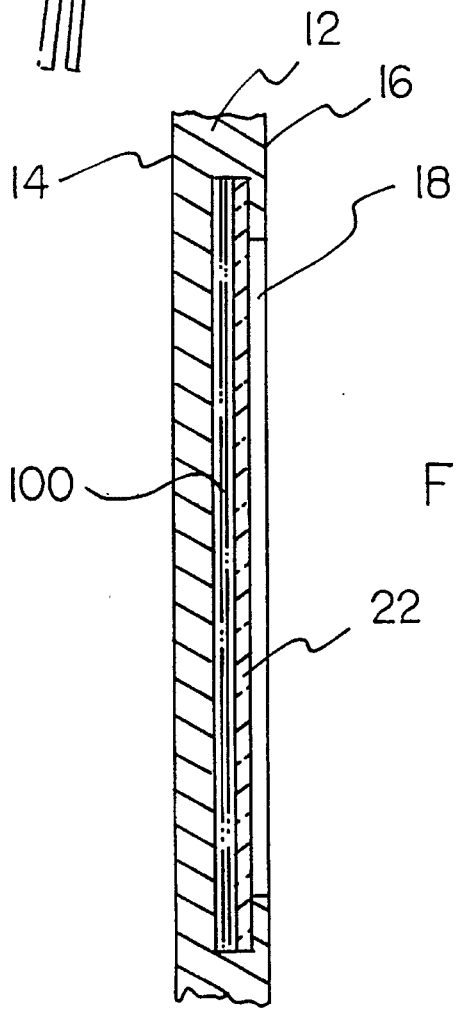
FIG. 4 is a cross-sectional views taken along line 4—4 of FIG. 1.

With reference now to the drawings, and in particular, to FIGS. 1–4 thereof, the preferred embodiment of the new and improved magnetic key holding plaque embodying the principles and concepts of the present invention and generally designated by the reference number 10 will be described.

Specifically, it will be noted in the various Figures that the device relates to a new and improved magnetic key holding plaque for holding keys with aid of magnets In its broadest context, the device consists of a plaque, a plurality of clear windows, a plurality of magnets, and a plurality of magnetic pendants. Such components are individually configured and correlated with respect to each other so as to attain the desired objective.

The device 10 includes a plaque 12 having an inner surface 14 and an outer surface 16. The outer surface 16 has a plurality of recesses 18 formed therein. The plaque 12 can be constructed in any number of geometric shapes and sizes. A preferred shape is shown in FIG. 1. Such a shape represents the shape of a lightning bolt.

A plurality of clear windows 22 are removably coupled within the plurality of recesses 18 of the plaque 12. The windows 22 can be easily removed to insert a photograph 100 into the recesses 18. The number and sizes of the plurality of windows 22 could be varied to correspond with the plurality of recesses 18.

A plurality of magnets 26 are secured within the inner surface 14 of the plaque 12. The magnets 26 could be used to secure the plaque 12 to a metallic background.

A plurality of magnetic pendants 30 are secured within the outer surface 16 of the plaque 12 opposed from the plurality of magnets 26. The plurality of magnetic pendants 30 each have indicia 32 thereon. The magnetic pendants 30 are adapted to hold a Set of keys 102. The pendants 30 can be constructed in any number of designs and sizes corresponding with the size of the plurality of magnets 26.

Figure 5:
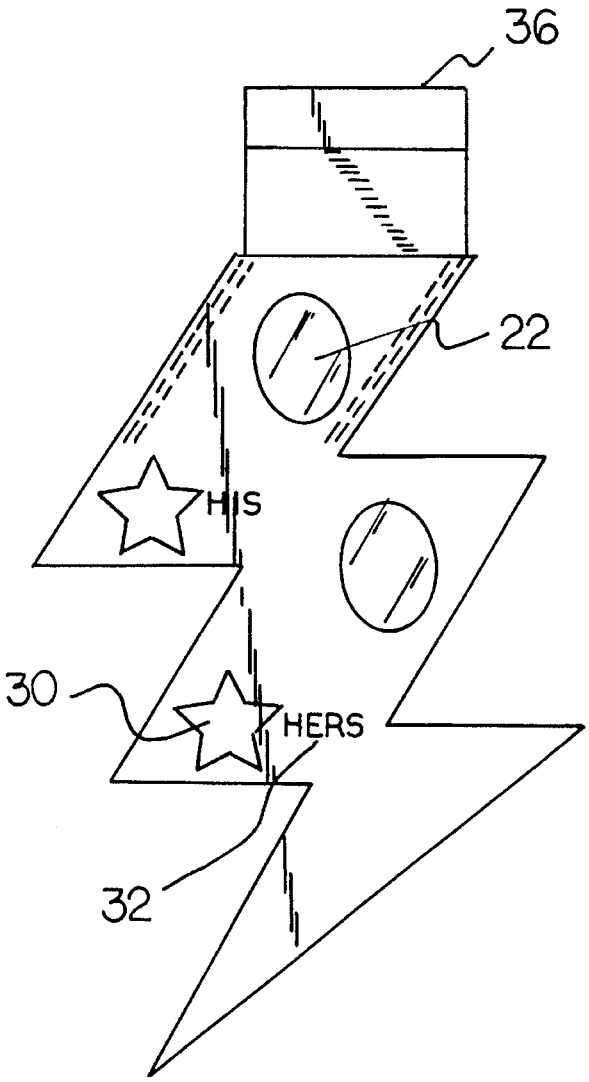
FIG. 5 is a front view of a second embodiment of the present invention.
Figure 6:
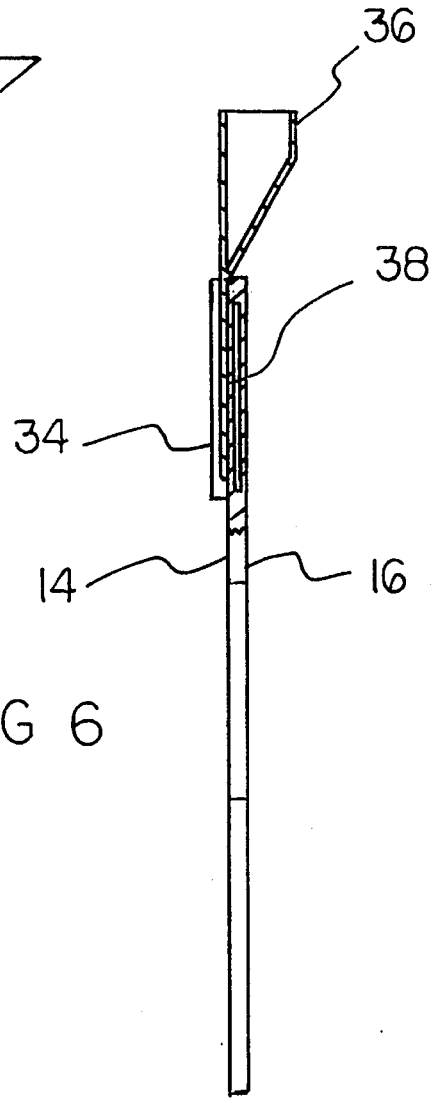
FIG. 6 is a side view of the second embodiment of the present invention.

A second embodiment of the present invention is shown in FIGS. 5 and 6 and includes substantially all of the components of the present invention further including a bracket 34 secured to an upper portion of the inner surface 14 of the plaque 12. A storage container 36 has a lower planar portion 38 slidably received within the bracket 34. The storage Container 36 is incorporated to hold any number of miscellaneous items.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in,the specification are intended to be encompassed by the present invention.

Therefore, the foregoing is considered as illustrative only of We principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A magnetic key holding plaque for holding keys with aid of magnets comprising, in combination:

a plaque having an inner surface and an outer surface, the outer surface having a plurality of recesses formed therein;

a plurality of clear windows removably coupled within the plurality of recesses of the plaque;

a plurality of magnets secured within the inner surface of the plaque;

a plurality of magnetic pendants secured within the outer surface of the plaque opposed from the plurality of magnets, the plurality of magnetic pendants each having indicia thereon.

2. The plaque as set forth in claim 1 wherein the inner surface of the plaque having a bracket secured to an upper portion thereof, a storage container having a lower planar portion slidably received within the bracket.

3. A magnetic key holding plaque for holding keys with aid of magnets comprising, in combination:

a plaque having an inner surface and an outer surface;

a plurality of magnets secured within the inner surface of the plaque;

a plurality of magnetic pendants secured within the outer surface of the plaque opposed from the plurality of magnets.

4. The plaque as set forth in claim 3 wherein the outer surface of the plaque having a plurality of recesses formed therein, a plurality of clear windows removably coupled within the plurality of recesses of the plaque.

* * * * *